US006483431B2

(12) United States Patent
Bert et al.

(10) Patent No.: US 6,483,431 B2
(45) Date of Patent: Nov. 19, 2002

(54) ELECTRICAL CIRCUIT FOR TRANSMITTING STATE INFORMATION, IN PARTICULAR CONCERNING SOME MEMBER IN RAILWAY ROLLING-STOCK, AND AN ELECTRICAL SYSTEM INCORPORATING SUCH A CIRCUIT

(75) Inventors: Michel Bert, Charly (FR); Ladimir Prince, Villette D'Anthon (FR)

(73) Assignee: Alstom, Paris (FR)

( * ) Notice: Subject to any disclaimer, the term of this patent is extended or adjusted under 35 U.S.C. 154(b) by 24 days.

(21) Appl. No.: 09/816,247

(22) Filed: Mar. 26, 2001

(65) Prior Publication Data

US 2001/0026227 A1 Oct. 4, 2001

(30) Foreign Application Priority Data

Mar. 31, 2000 (FR) ..... 00 04160
Jun. 15, 2000 (FR) ..... 00 07646

(51) Int. Cl.[7] ..... G08B 29/00
(52) U.S. Cl. ..... 340/509; 340/524; 340/679
(58) Field of Search ..... 340/509, 524, 340/525, 679

(56) References Cited

U.S. PATENT DOCUMENTS 3,975,708 A * 8/1976 Lusk ..... 340/525
4,314,238 A * 2/1982 Rombaut ..... 340/525
4,751,498 A * 6/1988 Shalvi ..... 340/524
4,855,709 A * 8/1989 Naderi ..... 340/525
5,497,380 A 3/1996 Bott et al. ..... 702/108
5,629,879 A 5/1997 Lelle ..... 714/735

FOREIGN PATENT DOCUMENTS

| | | |
|---|---|---|
| DE | 42 21 916 | 1/1994 |
| EP | 0 249 410 | 12/1987 |
| GB | 2 159 285 | 11/1985 |

OTHER PUBLICATIONS

French Search Report dated Nov. 17, 2000.
French Search Report dated Nov. 20, 2000.

* cited by examiner

*Primary Examiner*—Christine K. Oda
(74) *Attorney, Agent, or Firm*—Sughrue Mion, PLLC

(57) ABSTRACT

An electrical circuit for transmitting an item of information relating to the state of a parameter or of a piece of equipment, in particular for application in the railway field. The circuit includes a device for regulating the current flowing through the switch, including a switch device for switching over connections and having an inductive energy storage device and a capacitive energy storage device which, under steady conditions, alternate between being a device for storing and a device for restoring a fraction of the energy of the electrical circuit depending on the alternating state of the connections, as defined by the switch device. The invention also provides an electrical system incorporating such a circuit.

26 Claims, 5 Drawing Sheets

ELECTRICAL CIRCUIT FOR TRANSMITTING STATE INFORMATION, IN PARTICULAR CONCERNING SOME MEMBER IN RAILWAY ROLLING-STOCK, AND AN ELECTRICAL SYSTEM INCORPORATING SUCH A CIRCUIT

The invention relates to an electrical circuit for conveying on/off type information, in particular for an application to railways.

BACKGROUND OF THE INVENTION

In a train, numerous on/off type signals indicating the states of various parameters or pieces of equipment are conveyed, for example, to an automatic electronic control circuit, or to an instrument and control panel.

For example, such signals are representative of the state of a circuit breaker or of the open or closed position of a door giving passengers access.

These signals need to be carried with a high degree of security and availability, which makes computer-type low-current links unsuitable.

One solution now in use consists in connecting a closed loop electrical circuit to the two terminals of a battery, the circuit comprising in series: at least one switch associated with the state of the member to be monitored; a resistor; and an electrically isolated link connected to the device that is the destination for the information contained in the signal, for example the automatic electronic control circuit or the instrument and control panel.

The open or closed position of the switch is representative of the state of a parameter or of a piece of equipment. When the switch is closed, current of magnitude that is limited by the resistor flows in the circuit. When the switch is open, no current passes. The presence or the absence of said current is transformed by the electrically isolated link into on/off information that is communicated to the electronic circuit.

In general, a train has a plurality of such circuits connected to the terminals of the same battery.

Since switches tend to become oxidized, some minimum current of the order of a few tens of milliamps must pass through each of the switches in order to clean them.

This current is consumed and lost in the resistor.

Furthermore, the power dissipated in the resistor by the Joule effect produces heat which must be removed.

One solution would be to use fans.

However, at present, the use of fans for cooling electronic circuits on board trains is avoided or even banned for reasons of reliability, since a fan has mechanical components that might become jammed, cease moving, and in general, give rise to a breakdown.

The reliability of electrical and electronic components decreases significantly when ambient temperature increases, so it is desirable to produce as little heat as possible.

Furthermore, since the battery generally powers a plurality of other circuits and equipment, the voltage it delivers varies over time depending on the load across its terminals.

The magnitude of the current in the circuit thus also varies, in proportion to the state of charge of the battery.

Consequently, to obtain the minimum current required for cleaning the switches, it is necessary to consume a large amount of extra current (and thus power) during certain periods in the operation of the circuit. The additional heat which is produced further complicates the problem of removing this heat.

The quantity of heat dissipated increases with the number of switches and the amount of information to be transmitted.

OBJECTS AND SUMMARY OF THE INVENTION

The invention seeks to reduce the above-mentioned drawbacks of the prior art.

The invention thus seeks to convey on/off type information with a high degree of reliability and of availability, while nevertheless reducing the amount of heat dissipated by the Joule effect.

The invention thus provides an electrical circuit for transmitting the state of a parameter or of a piece of equipment and designed to be connected to the terminals of a power supply battery, the circuit comprising:

- an isolated link between said electrical circuit and an output for sending an item of state information; and
- a switch whose open or closed position is representative of the state information and determines whether or not a current flows in said electrical circuit;
- the electrical circuit transmitting state information from the switch to the output via the isolated link;
- the electrical circuit comprising means for regulating the magnitude of the current flowing through the switch, said means comprising switch means, connections between component elements of the electrical circuit and comprising inductive energy storage means in series with the switch and capacitive energy storage means which, under steady conditions, alternate between constituting means for storing and means for restoring a fraction of the energy of said electrical circuit, depending on the alternating state of said connections between the component elements of the electrical circuit, as determined by the switch means.

According to other characteristics of this electrical circuit:

- the isolated link is connected in series with the switch;
- the means for regulating the current through the switch further include means for monitoring a magnitude that is characteristic of the state of the electrical circuit and for controlling the switch means to alternate connections between the elements constituting the electrical circuit as a function of the state of said electrical circuit;
- the switch means for switching the connections between the elements constituting the electrical circuit establish at least the following connections in an alternation: the inductive energy storage means, the switch, the power supply battery, and the capacitive energy storage means in series in a closed loop during a first stage, under steady conditions, in which the inductive energy storage means restore a quantity of energy which is stored in the capacitive energy storage means; and the inductive energy storage means, the switch, and the capacitive energy storage means in series in a closed loop during a second stage, under steady conditions, in which the capacitive energy storage means restore a quantity of energy which is stored by the inductive energy storage means; the polarity of the connections between the inductive energy storage means and the capacitive energy storage means being inverted between the first and second stages.
- the inductive energy storage means and the capacitive energy storage means comprise respectively: an inductor in series with the switch; and a capacitor; first and second parallel-connected branches in series with the switch and the inductor, and includes a resistor in parallel with the switch and the inductor, and connected to a point of the second branch, the capacitor being connected in the second branch; and the means for switching the connections comprises means for directing the current flowing through the switch and the inductor through the first and second branches in alternation;

the isolated link is connected in the first branch;

the isolated link is connected in series with the capacitor in the second branch;

the isolated link is connected in series with the resistor;

the period during which the current flowing through the switch and the inductor flows successively through the first branch and then through the second branch, and the duty ratio which is equal to the time said current flows through the first branch divided by said period, are respectively fixed and variable, and are determined by the means for monitoring the magnitude characteristic of the state of the electrical circuit and for periodically controlling the switch means;

the means for directing the current passing through the switch and the inductor alternately through the first branch and through the second branch comprise a controlled switch connected in the first branch and a diode connected in the second branch between firstly one of the two junctions between the first and second branches, and secondly the connection point between the resistor and the second branch, the capacitor lying between the other one of said two junctions between the first and second branches, and the connection point of the resistor and the second branch;

the isolated link is connected in series with the diode;

the isolated link consists in an optocoupler;

the isolated link consists in a transformer;

the primary winding of said transformer also forms at least a portion of the inductive energy storage means;

said means for monitoring a magnitude characteristic of the state of the electrical circuit and for periodically controlling the switch means also form the isolated link and for this purpose are provided with said outlet for sending the information and are suitable for sending this information on the basis of processing said characteristic magnitude, in particular on the basis of the duty ratio;

the peak value during a period of the current flowing through the switch constitutes said magnitude characteristic of the state of the electrical circuit;

the potential at the point where the resistor is connected to the second branch constitutes said magnitude characteristic of the state of the electrical circuit;

the voltage across the terminals of the resistor constitutes said magnitude characteristic of the state of the electrical circuit;

it further includes means for testing correct operation thereof, independently of the position of the state switch;

the means for testing correct operation of the electrical circuit include:

a controlled test switch and a test battery connected in a first series circuit which is in turn connected in parallel with a second series circuit including the state switch and a location for connecting the power supply battery; and an automatic test unit connected to the control terminal of the controlled test switch and to the outlet for transmitting state information;

the means for testing correct operation of the electrical circuit include:

a controlled test switch connected in parallel with the state switch, the assembly being connected in series with a location for connecting the power supply battery that is also to operate as a test battery; and an automatic test unit connected to the control terminal of the controlled test switch and to the outlet for transmitting state information;

the automatic test unit, also connected to the means for monitoring a magnitude that is characteristic of the state of the electrical circuit and for operating the switch means of the connections in alternation, is suitable for holding said switch means in at least one current cut-off position in said electrical circuit;

the means for testing correct operation of the electrical circuit include at least one protective diode connected in series with the state switch to block current coming from the controlled test switch; and the means for testing correct operation of the electrical circuit include another protective diode connected in series with the controlled test switch to block current coming from the state switch.

The invention also provides an electrical system for transmitting a plurality of items of state information, the system comprising a battery and a plurality of electrical circuits as defined above, each serving to transmit one item of state information and all connected in parallel across the terminals of said battery.

According to other characteristics of this electrical system, it is mounted on board a railway train, each switch being associated with a member or with a piece of equipment of said railway train, to monitor the state or the position thereof.

BRIEF DESCRIPTION OF THE DRAWINGS

The invention will be better understood on reading the following description given purely by way of example and made with reference to the accompanying drawings, in which.

MORE DETAILED DESCRIPTION

Figure 1:
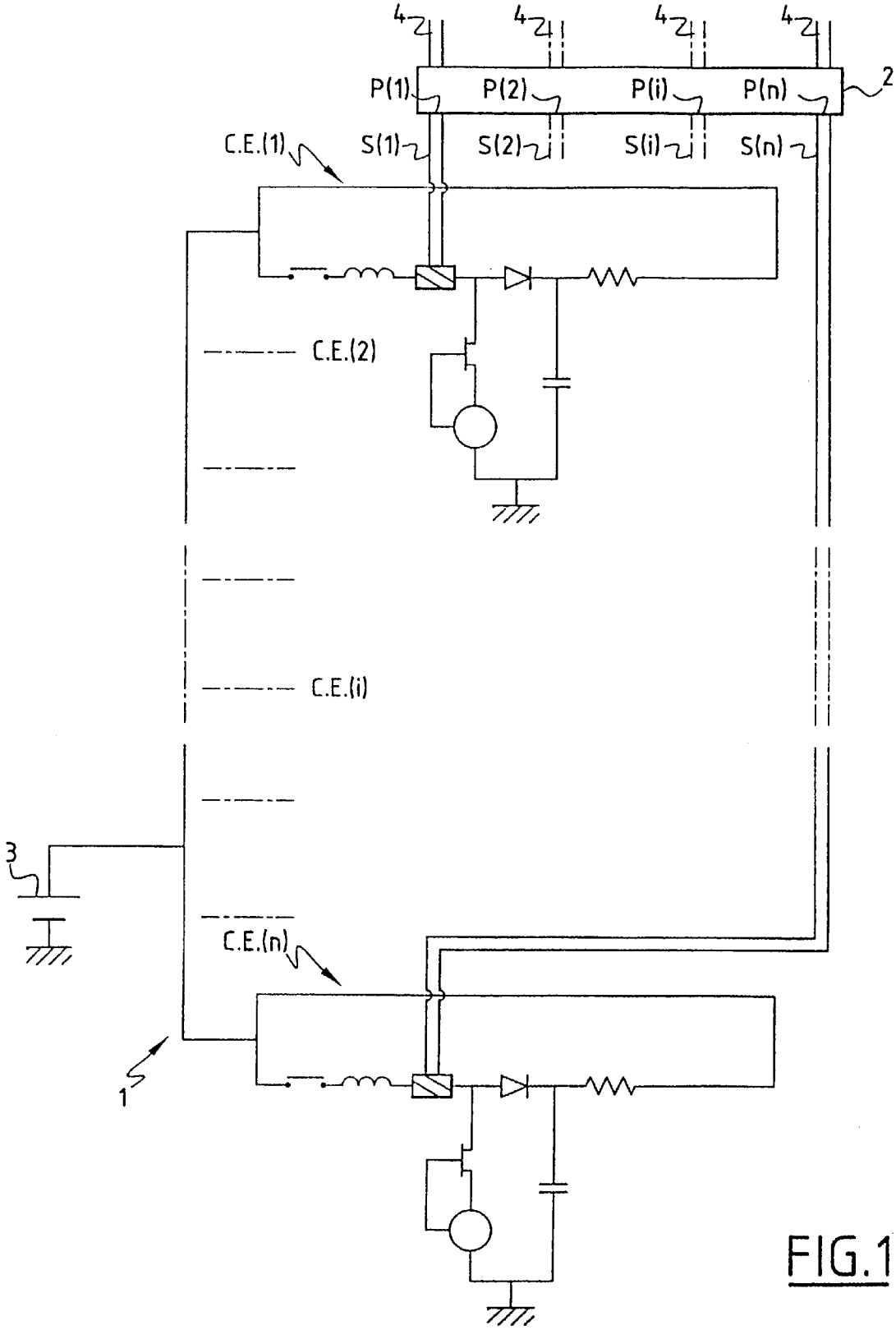
FIG. 1 shows an electrical system constituting a first variant embodiment of the invention for transmitting a plurality of items of on/off information.

A first variant embodiment of the electrical system 1 of the invention is shown in FIG. 1.

The electrical system 1 is suitable for transmitting a plurality of items of on/off information to an electronic circuit 2 for controlling automatic equipment.

The electrical system 1 comprises a plurality of individual electrical circuits CE(i), in this case n such circuits, connected in parallel between the terminals of a power supply battery 3. As explained below, each individual circuit CE(i) is suitable for transmitting a single item of on/off information representative of the state of a member or of a piece of equipment to be monitored, in particular equipment in a railway vehicle.

At the output from each individual circuit CE(i), a connection S(1) . . . S(i) . . . S(n) recovers the on/off information by means of a link which is described below and transmits it to one of the inlet ports P(1) . . . P(i) . . . P(n) of the electronic circuit 2.

The electronic circuit 2 will also has outlet ports 4, e.g. for controlling automatic equipment (not shown).

In the main intended application, the power supply battery 3, the electrical system 1, and the electronic circuit 2 are designed to be mounted on board a train. Naturally, the electronic circuit 2 for controlling automatic equipment can be replaced by a control and display panel or by any device suitable for receiving and processing on/off information.

Generally, the power supply battery 3 is the only source of DC for the entire train. Thus, all of the on-board equipment requiring DC power is powered by this sole battery 3. The voltage it delivers can therefore vary in time, as a function of the load at its terminals, over the range 0.6 times to 1.4 times its nominal voltage.

At present, the storage batteries 3 commonly in use in trains have nominal voltages of 24 volts, 36 volts, 48 volts, 96 volts, and 110 volts.

Figure 2:
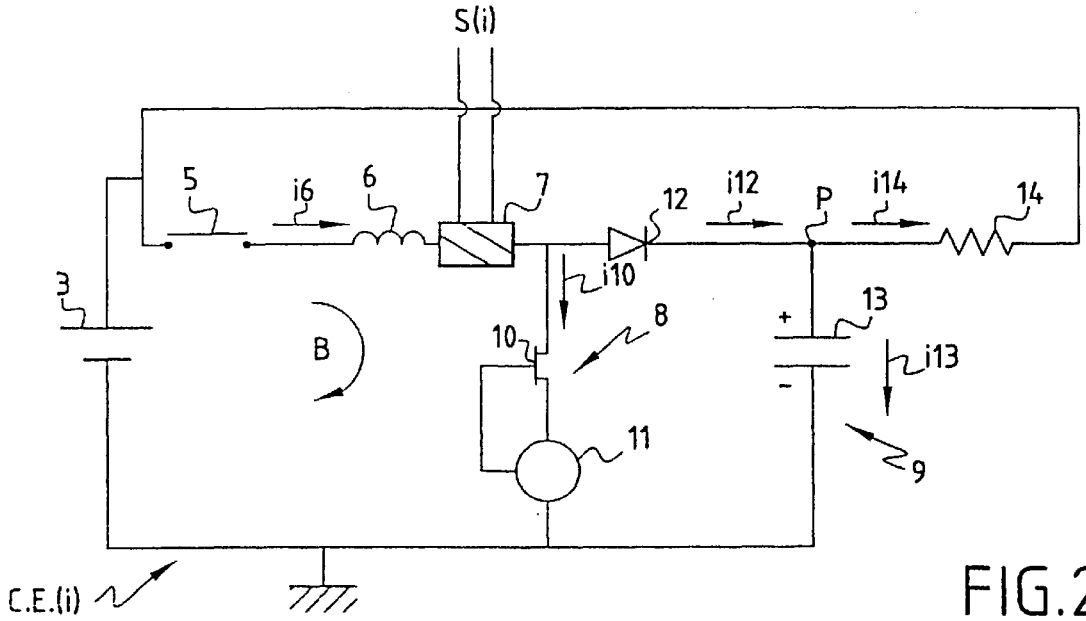
FIG. 2 shows an individual electrical circuit of the electrical system of FIG. 1 for transmitting a single item of on/off information.

For reasons of clarity, FIG. 2 shows a single individual electrical circuit CE(i) used in making the electrical system 1. The individual circuit CE(i) has a loop B powered by the battery 3 and comprising, connected in series: a state switch 5, an inductor 6, an electrically isolated link 7 which can be constituted, for example, by means of an optocoupler, and two parallel branches 8 and 9.

For reasons of convenience, the following convention is adopted in the description below: the direction in which the current flows in the loop B from the +terminal to the −terminal of the battery 3 defines a positive direction for the loop B.

The branch 8 comprises, connected in series: a transistor 10, and a regulator device 11 controlling said transistor 10. The transistor 10 is biased in such a manner that the current flowing between the two main electrodes of the transistor, other than its control electrode, is positive using the conventional direction for the loop B as adopted above.

The regulator device 11 has means for measuring the magnitude of the current traveling along the branch 8, and also a clock (not shown).

The second branch 9 comprises a diode 12 and a capacitor 13 in series.

The resistor 14 is connected between a point P of the branch 9 located between the diode 12 and the capacitor 13, and the +terminal of the battery 3.

The diode 12 is biased so as to prevent and the capacitor 13 from discharging other than through the resistor 14.

The member or equipment whose state is to be monitored actuates opening and closing of the state switch 5.

When the switch 5 is open, no current flows in the loop B through the isolated link 7, and if the link is an optocoupler, it then delivers no output current to the connection S(i) or output for transmitting state information.

By way of example, the control frequency of the transistor 10 is fixed at around 240 kHz, by the clock of the regulator device 11. During one period T defined as being the inverse of this control frequency of the transistor 10, the transistor is caused consecutively to be conductive and then nonconductive. In the example described, this period is fixed, but in other embodiments it could be variable. The duty ratio $\alpha$, equal to the time during which a transistor 10 is conductive divided by the period T, is variable. It is determined by the regulator device 11 by comparing the peak value of the current flowing in the branch 8 during one period T with a reference value of about 25 mA stored in the regulator device 11 so as to regulate the current in the loop B.

When the switch 5 is open, the current of the branch 8 is zero, and thus below the reference value of the regulator device 11. The duty ratio $\alpha$ is then equal to 1 and the transistor 10 is conductive continuously.

It should also be observed that when the switch 5 is in this position, the potential Vp at point P is equal to the voltage E across the terminals of the battery 3.

When the switch 5 is actuated from its open position to its closed position, then a transient stage begins. When the transistor 10 is conductive, the inductor 6 of inductance L and of resistance r is subjected to the voltage E delivered by the battery 3. The current $i_6$ passing through the inductor 6 is given by the following equation:

$$E=L(di_6/dt)+ri_6$$

and increases exponentially as a function of time t in the general case and substantially linearly when the control period is much shorter than the time constant of the inductor 6, which is equal to L/r.

After one or more periods T, the current $i_6$ reaches a value such that the duty ratio $\alpha$ begins to depart from its initial value equal to 1, and the transistor 10 ceases to conduct.

The inductor 6 demagnetizes by means of a current $i_{12}$ passing through the diode 12 towards the point P. This current $i_{12}$ splits at P into two currents $i_{13}$ and $i_{14}$ passing respectively through the capacitor 13 and the resistor 14. The current $i_{14}$ is initially relatively small since most of the current $i_{12}$ coming from the diode 12 goes to the capacitor 13. The current $i_{13}$ increases the charge in the capacitor 13 and thus the potential Vp at the point P increases to above its initial value E.

At the end of the period T, the transistor 10 conducts again and if the switched 5 is still closed, the above-described cycle repeats several times in substantially identical manner except that the potential Vp at the point P increases.

On each new cycle, the potential Vp increases progressively and it tends towards a stabilization value after the transient stage as described above. The stabilization value Vp is reached when the mean current $i_{14}$, as determined by the voltage across the terminals of the resistor 14 and the resistance R of the resistor 14 by the following relationship:

$$i_{14}=(Vp-E)/R$$

is equal to the mean value of the current $i_{12}$ passing through the diode 12.

Thereafter, the individual circuit CE(i) embarks on substantially stable conditions. The value of the potential Vp at point P is then substantially constant.

Figure 3A:
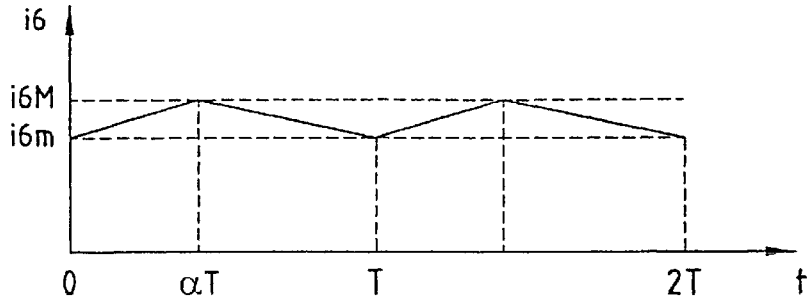
FIGS. 3*a*, 3*b*, and 3*c* are graphs showing ideal values for current as a function of time, in three respective branches of the FIG. 2 circuit.
Figure 3B:
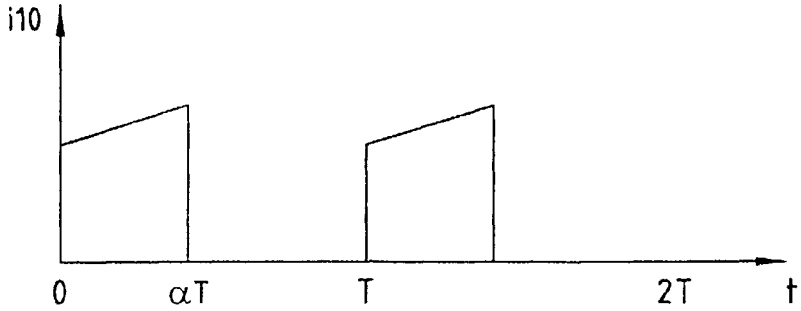
Figure 3C:
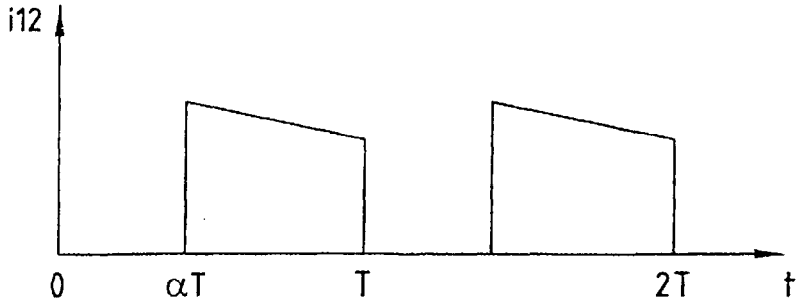

FIGS. 3*a*, 3*b*, and 3*c* show how the individual circuit CE(i) operates once it has started on substantially stable conditions in which the current flowing through the inductor is not interrupted.

More precisely, curve 3*a* shows how the current $i_6$ varies as a function of time in the inductor 6, while curves 3*b* and 3*c* show the contribution of this current $i_6$ to the currents $i_{10}$ passing through the transistor 10 and $i_{12}$ passing through the diode 12.

While the transistor 10 is conductive at the beginning of a period T for a duration αT, the potential E of the battery 3 is applied to the inductor 6. The current $i_6$ which flows through the switch 5, the inductor 6, the isolated link 7, and the transistor 10 is determined, to a first approximation and assuming the control period is very short compared with the time constant of the inductor 6, by the following equation:

$$E=L(di_6/dt) \text{ or indeed } i_6=Et/L+i_{6m}$$

in which t is time and $i_{6m}$ is the minimum value of the current $i_6$ at the instant when the transistor 10 becomes conductive.

The magnitude of the current $i_6$ increases approximately linearly during the time t at a slope E/L starting from a minimum value $i_{6m}$ and rising to a maximum value $i_{6M}$.

After a duration αT, the transistor 10 switches off and remains nonconductive until the end of the period T. The voltage across the terminals of the inductor 6 is equal to E−Vp, the potential Vp at point P is substantially constant and greater than E. The current $i_6$ flowing through the inductor 6 is, to a first approximation, determined to by the following equation:

$$i_6=(E-Vp)t/L+i_{6M}$$

and decreases linearly are from the maximum value $i_{6m}$ to the minimum value $i_{6m}$.

This current $i_6$ flowing through the inductor 6 flows in part in the closed loop comprising the inductor 6, the diode 12, the capacitor 13, the battery 3, and the switch 5. The other part of this current $i_6$ flows through the resistor 14 and the closed loop comprising the inductor 6, the diode 12, the resistor 14, and the switch 5.

The part of the current $i_6$ flowing through the capacitor 13 when the transistor 10 switches off and the inductor 6 discharges, maintaining the charge on the capacitor 13 and the potential Vp at the point P.

The capacitor 13 discharges during the time αT while the diode 12 is nonconducting, and the amount of this discharge must, on average, be equal to the amount by which the capacitor is recharged via the diode 12 during the time (1−α)T, under steady conditions.

When it discharges, the capacitor 13 returns a fraction of its energy to the circuit by feeding at least the switch 5, the inductor 6, the isolated link 7, and the transistor 10, and possibly also feeding the battery 3.

From the energy point of view, at the beginning of the period T, and during the time αT, the capacitor 13 discharges and a fraction of its energy is transferred to the inductor 6 which magnetizes, thereby generating the current $i_6$ through the switch 5, the inductor 6, the isolated link 7, and the transistor 10. At the end of the period T, during the time (1−α)T, the inductor demagnetizes and a fraction of its energy is transferred to the capacitor 13 which charges, thereby generating the current $i_6$ in the switch 5, the inductor 6, and the isolated link 7.

The current $i_6$ is thus partially a consequence of energy being transferred from the capacitor 13 to the inductor 6, and then from the inductor 6 to the capacitor 13. It should be observed that between these two energy transfer stages, the polarity of the connections between the inductor 6 and the capacitor 13 is reversed. The battery 13 maintains the energy level of the circuit by compensating losses, particularly in the resistor 14. Another function of the battery 3 is to supply the initial energy to the circuit during the transient starting stage described above.

The regulator device 11 determines the duty ratio α in such a manner as to regulate the current $i_6$ flowing through the inductor 6. While the transistor 10 is conductive, the current $i_6$ increases. Conversely, the current $i_6$ decreases while the transistor 10 is nonconductive. The duty ratio α thus determines the increase and decrease stages in the current $i_6$ during a period T. By increasing one of said durations relative to the other, the regulator device 11 can vary the current $i_6$ between the beginning and the end of the period T.

Under steady conditions as shown in FIG. 3*a*, although the current $i_6$ in the inductor 6 is not completely steady, it nevertheless varies only over a small range lying between $i_{6m}$ and $i_{6M}$. Its mean value is adjusted in such a manner as to ensure that the switch 5 passes at least the minimum current that is required for cleaning it.

The current passing through the inductor 6 also passes through the isolated link 7.

Thus, when the switch 5 is closed, current is established in the isolated link 7 which responds by producing an output signal on the connection S(i).

It is advantageous for the isolated link 7 to be placed in series with the switch 5 since the output signal it generates is a substantially true image of the current flowing through the switch 5.

It will be observed that the greater the capacitance C of the capacitor 13, the more the potential Vp is stable.

The variation in the voltage across the terminals the capacitor 13 as a function of a given variation in its load is inversely proportional to its capacitance C.

Nevertheless, the durations of the transient conditions on the switch 5 are being opened or closed and a during which the capacitor 13 is charged or discharged, and that should be as short as possible, also vary with the capacitance C of the capacitor 13 and in the same direction as the capacitance. Thus determining a value for C lies in finding a compromise.

The current coming from the capacitor 13 or output current passing through the resistor 14 is the current which serves to discharge the capacitor of 13. Under steady conditions, the mean current leaving a capacitor 13 is equal to the current $i_6$ coming from the inductor 6 entering the capacitor. This current is determined by the regulator device 11.

Consequently, the current coming from the capacitor 13 and flowing through the resistor 14 is likewise determined by the regulator device 11. The potential difference Vp−E across the terminals of the resistor 14 takes on a value proportional to the magnitude of said current and inversely proportional to the resistance R of the resistor 14. Thus the resistance R of the resistor 14 serves to determine the potential difference Vp−E, with the value of the current $i_6$ being fixed elsewhere.

In operation, the invention as described above reduces the amount of energy dissipated by the Joule effect in two ways.

Firstly, the battery 3 maintains energy level in the circuit, and it is only the power released by the battery for this purpose which is consumed by the Joule effect. The current $i_6$ flowing through the switch 5 is not limited solely by a resistor which necessarily dissipates that current by the Joule effect as in the prior art, but also by a quantity of energy being transferred in alternation, causing the magnitude of the current $i_6$ to increase and to decrease and enabling it to be regulated.

Secondly, the magnitude of the current $i_6$ injected into the circuit is regulated by its maximum value $i_{6M}$ which is independent of the voltage E delivered by the battery 3. Contrary to that which is obtained in the prior art, variation in the voltage E delivered by the battery 3 does not give rise to variation in the current consumed by the resistor 14.

Figure 4:
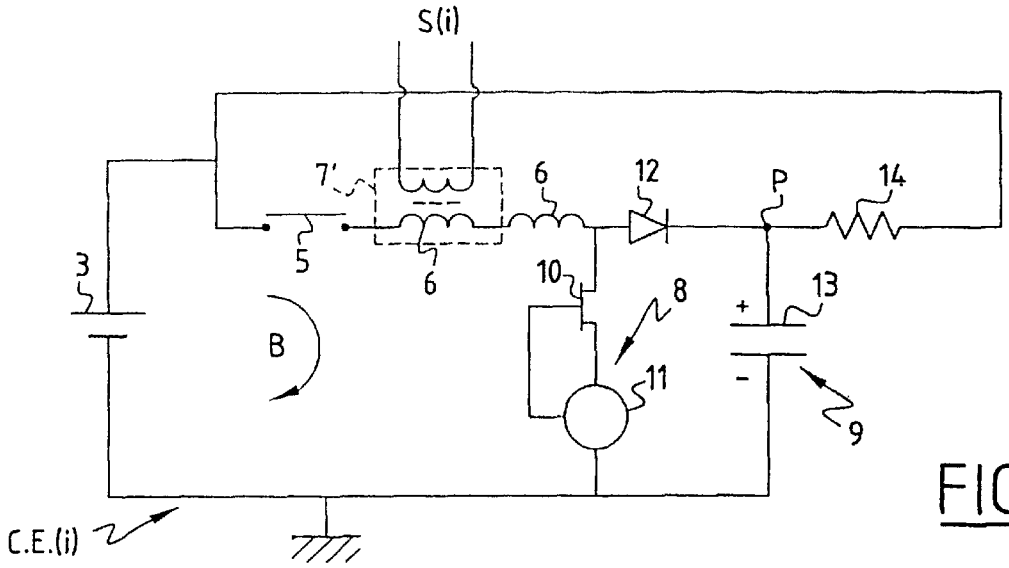
FIG. 4 shows an individual circuit analogous to that of FIG. 2 constituting a first variant embodiment of the invention.

In FIG. 4, the isolated link is constituted by magnetic coupling performed by transformer 7', having an air gap when the DC component of the current flowing through the primary is large, and whose primary winding also forms at least a portion of the winding of the inductor 6. The secondary is connected to the connection S(i).

The operation of the individual circuit CE(i) remains unchanged. The variation in the current $i_6$ through the inductor 6 between $i_{6m}$ and $i_{6M}$, while the switch 5 is closed, causes a voltage and/or a current to be output across the terminals of the secondary winding of the transformer 7' constituting the output signal, after being rectified by a rectifier (not shown).

Figure 5:
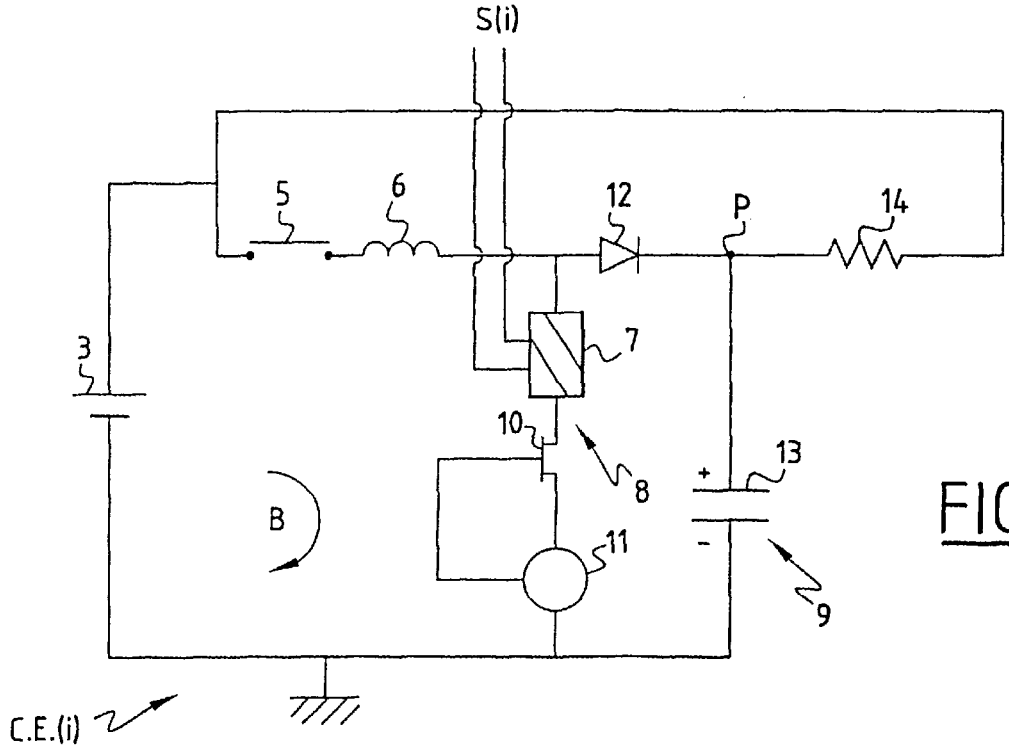
FIG. 5 shows an individual circuit analogous to that of FIG. 2 constituting a second variant embodiment of invention.

In the variant embodiment shown in FIG. 5, the isolated link 7 has been moved from a position where it is in series with the inductor 6 to a position where it is in series with that the transistor 10, on the branch 8. The operation of the individual circuit CE(i) remains the same, the output signal picked up by the connection S(i) being intermittent like the current $i_{10}$ flowing through the transistor 10. Means enabling this output current to be smoothed or averaged can be provided on the output circuit associated with the output connection S(i).

Figure 6:
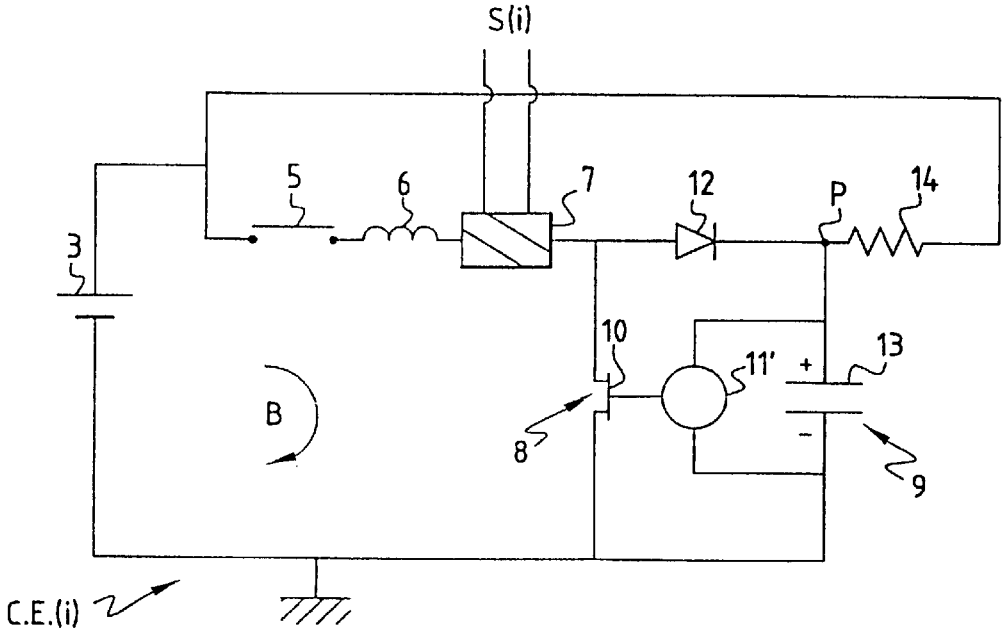
FIG. 6 shows an individual circuit analogous to that of FIG. 2 constituting a third variant embodiment of invention.

In the variant embodiment of FIG. 6, the regulator device 11 has been replaced by a regulator device 11' which has means for measuring the voltage Vp across the terminals of the capacitor 13.

The regulator device 11' determines the duty ratio $\alpha$ and controls the transistor 10 in such a manner as to regulate the voltage Vp across the terminals of the capacitor 13 about a reference value.

As the duty ratio $\alpha$ increases, the mean magnitude of the current $i_6$ through the inductor 6 increases as described above, as does the fraction of this current $i_6$ which flows through the capacitor 13 and the load. This has the effect of increasing the potential Vp at the point P.

Under steady conditions, the mean current leaving the capacitor 13 must be equal to the mean current coming from the inductor 6 which enters the capacitor. However, this current leaving the capacitor 13 and which discharges the capacitor, also flows through the resistor 14 and is determined by the potential difference Vp−E across terminals of the resistor 14.

In contrast, a decrease in the duty ratio $\alpha$ enables the potential Vp at the point P to be decreased, thereby decreasing the mean value of the current $i_6$ flowing through the inductor 6. The operation of the individual circuit CE(i) remains otherwise unchanged.

An advantageous variant method of control measures the voltage Vp−E across the terminals of the resistor 14 to regulate the current through the resistor 14 using the relationship (Vp−E)/R and thus the dissipated power $(Vp-E)^2/R$, while maintaining current through the switch 5 that decreases a little as a function of the voltage from the battery 3.

The invention is not limited to the variant embodiments described above. In particular, the isolated link can be placed on any of the branches of the individual circuit CE(i), for example in series with the diode 12, the capacitor 13, or the resistor 14.

Similarly, the transistor 10 can be replaced by any type of controlled switch.

The output information can also be generated by the regulator device 11 or 11', which then provides the function of the isolated link 7 or 7' on the basis of the value of the duty ratio $\alpha$, which value is equal to 1 when the switch 5 is open and different from 1 when it is closed.

In addition, a breakdown, e.g. following the failure of a component, can occur in an individual circuit CE(i) of the invention without being detected, or at least without being detected for a relatively long period of time, and this degrades the desired reliability.

Insofar as the state switch determines whether or not current flows in the individual circuit CE(i), it can be envisaged to use said state switch to perform an operating test in which effective reception of the on/off signal is verified. However, the state switch is not always accessible and/or easily actuated. For example, it can be disposed in a place on the train that is far from the place where reception is tested.

Figure 7:
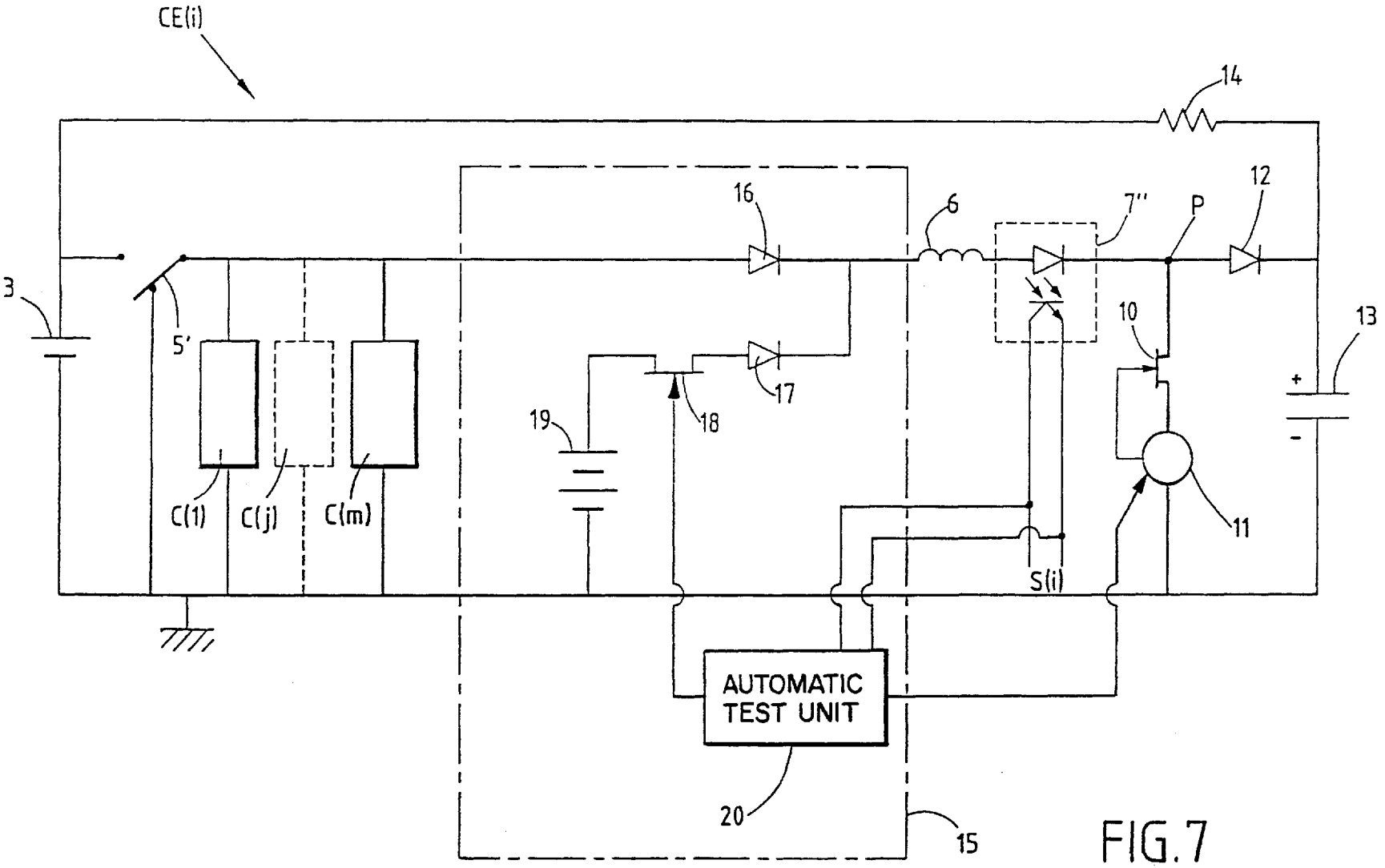
FIG. 7 shows an individual circuit of the same kind as the first variant embodiment of the invention shown in FIG. 2, the individual circuit further including means for automatically testing whether it is operating correctly.

Thus, the individual circuit CE(i) shown in FIG. 7 includes means 15 suitable for testing its correct operation, whatever the position of the state switch.

The basic structure of the individual circuit CE(i) is identical to that of the first variant embodiment of the invention shown in FIG. 2 and described above, and it includes the same elements. However, in this case the state switch and the isolated link are respectively formed by a changeover switch 51 and an optocoupler 7", this particular choice being designed solely to show certain characteristics.

The means 15 for testing correct operation of the individual circuit CE(i) include a protective diode 16 disposed between the changeover switch 5' and the inductor 6, and biased so as to enable positive current to pass in the direction of the loop B that is adopted above as being the conventional direction. The changeover switch 5' and the power supply battery 3 are connected in parallel with the series circuit including the protective diode 16. Another series circuit comprises another protective diode 17, a controlled test switch formed by a transistor 18, and a test battery 19, all three of which belong to the means 15. The protective diode 17 and the test battery 19 are biased so that said test battery is suitable for powering the individual circuit CE(i), with the exception of the changeover switch 5', by producing a current in the same direction as that supplied by the power supply battery 3, but in place of said power supply battery 3.

Relative to the current transmitted by the positive terminal of the test battery 19, the protective diode 17 is advantageously disposed downstream of the transistor 18, which is itself disposed downstream of the test battery 19.

The means 15 for testing correct operation of the electrical circuit CE(i) also include an automatic test unit 20 connected to the transistor 18 and advantageously to the regulator device 11, and receiving the state information transmitted by the optocoupler 7" by means of a branch on the connection S(i).

The protective diode 16 is advantageously situated on one side or the other of the assembly including the changeover switch 5' and the power supply battery 3 in series. Thus, the optional loads C(1) . . . C(j) . . . C(m) shown to illustrate certain operating characteristics, and formed by relays, actuators, circuit-breaker closure coils, and/or pilot lamps, for example, and whose states, like that of the optocoupler 7", are designed to be associated with the open or closed position of the changeover switch 5', are each disposed in parallel with the series circuit including the changeover switch 5' and the power supply battery 3, with the exception of the protective diode 16.

Except during testing, operation of the electrical circuit CE(i) remains identical to that described above, the current passing through the changeover switch 5' and the inductor 6 also passing, in this case, through the protective diode 16.

The automatic test unit 20 is suitable for performing an automatic test to verify that the electrical circuit CE(i) is operating correctly, said test being triggered each time the train starts, for example.

It should be noted that the changeover switch 5', which can be tedious to actuate because of the high number of such switches, could equally well be in an open position or a closed position.

During a first step of the test, the automatic test unit 20 closes the transistor 18, thus ensuring that the portion of the electrical circuit CE(i) situated downstream of the protective diode 16 is powered. The unit 20 thus verifies the transmission, in the connection S(i), of information representative of current passing through the optocoupler 7", which transmission must occur when said portion of the circuit CE(i), situated downstream of the protective diode 16, is functioning correctly.

Since the isolated link is, in this case, formed by an optocoupler 7", it should also be verified that the phototransistor of the optocoupler, which conducts when it receives light information as a result of current passing through the associated phototransmitter diode, takes up a non-conductive state, corresponding to an open switch, in the absence of current. Unfortunately, as mentioned above, the changeover switch 5' might be in any state. Thus, in a second step of the test, the automatic test unit 20 uses the regulator device 11 to keep the transistor 10 in the non-conductive state. The current which passes through the optocoupler 7" is progressively reduced as a result of the energy stored in the inductor 6 during a transient period which can be estimated at five times the time constant of said inductor ($5\times L/r$). Since the voltage at the terminals of the test battery 19 is, in this case, chosen to be equal to or less than the voltage at the terminals of the battery 3, the current which might flow through the resistor 14 from one of the two batteries to the other because of the potential difference at their terminals, is prevented from flowing by the protective diode 17. After waiting for the transient period to pass, the automatic test unit 20 verifies that the signal that it receives from the connection S(i) effectively corresponds to the phototransistor of the optocoupler 71" being in a non-conductive state.

During the test considered as a whole, only the protective diode 16 is not tested, and consequently, this diode is advantageously overdimensioned.

When the voltage at the terminals of the power supply 3 is greater than the voltage at the terminals of the test battery 19, the protective diode 17 prevents a current from being established between the two batteries if the changeover switch 5' is closed when the automatic test unit 20 maintains the transistor 18 in the conductive state.

The protective diode 17, advantageously disposed downstream from the transistor 18 relative to a current transmitted by the positive terminal of the test battery 19, also protects the transistor 18 from the destructive effects of a too-great a negative voltage at its terminals.

For its part, the protective diode 16 isolates the batteries 3 and 19 and prevents a current from passing therebetween when the test voltage is greater than the power supply voltage, a situation that can be encountered when the second step of the above-mentioned test is not performed, e.g. because the isolated link is not an optocoupler.

The protective diode 16 also prevents a short-circuit current transmitted by the test battery 19 from being established when the changeover switch 5' is in the open position, i.e. when it disconnects the individual circuit CE(i) from the power supply battery 3 and imposes a zero voltage at the terminals of the individual circuit CE(i), while at the same time, the transistor 18 is conductive. Naturally, the situation to be avoided does not exist when the changeover switch 5' is replaced by a simple on/off switch.

The protective diode 16 also prevents the loads C(1) . . . C(j) . . . C(m) from being powered by the test battery 19 when the transistor 18 is conductive. It should be noted that the states of the loads are designed to be associated with that of the changeover switch 5'.

In a variant, the power supply battery 3, while conserving its disposition inside the electrical circuit CE(i), can also be connected so as to replace the test battery 19. In such a disposition, the power supply battery successively fulfills two distinct functions at different times, thus avoiding the need for a specific test battery. The transistor 18 is thus directly connected in parallel with the changeover switch 5'. The protective diode 17 becomes superfluous. As for the protective diode 16, only the presence of the loads C(1) . . . C(j) . . . C(m) or the use of a changeover switch 5' instead of an on/off switch make it necessary.

Naturally, any type of switch can replace the changeover switch 5', said changeover switch having been chosen only to illustrate the particular role performed by the protective diode 16 when it is used.

Since the optocoupler 7" has been chosen for similar reasons, it too can be replaced by any other component suitable for making an isolated link. Some such components, e.g. the above-mentioned transformer, do not require a second test stage since on their own, i.e. without any current passing therethrough, they cannot generate an output signal on the connection S(i) corresponding to such a current. In this case, the connection connecting the automatic test unit 20 to the regulator device 11 is no longer necessary.

For its part, the transistor 18 can be replaced by any component acting as a controlled switch.

The means 15 for testing correct operation of the electrical circuit CE(i) are designed to be adapted to any variant embodiment of the invention, e.g. to all those which are described above, although the means 15 have been presented in a particular combination with only one of them.

The invention is not limited to a railway application, but relates to transmitting on/off information in any field.

The advantages of the invention include reducing the total power dissipated by the Joule effect in a circuit of invention, thus making it possible, for given temperature and cooling air speed conditions, to reduce the size of the resistors, where resistors are the bulkiest of the components used.

This reduction in size makes it possible to reduce the size of a read channel, and thus to provide room for a larger number of read circuits for a given area of electronic circuit card, even though the number of components is larger.

The means 15 for automatically testing the operation of the electrical circuit CE(i) have, in particular, the advantage of being presented in the form of a simple circuit, using few components and consequently being low in cost.

In addition, the means 15 enable a test to be implemented that provides coverage that is close to 100%, only the protective diode 16 is not verified.

Overdimensioning the protective diode 16 significantly limits the risk of it giving rise to a breakdown.

What is claimed is:

1. An electrical circuit for transmitting the state of one of a parameter and of a piece of equipment and operative to be connected to terminals of a power supply battery, the circuit comprising:

an isolated link between said electrical circuit and an output for sending an item of state information; and a state switch whose open or closed position is representative of the state information and determines, while not testing, whether or not a current flows in said electrical circuit; the electrical circuit transmitting state information from the state switch to the output via the isolated link;

the electrical circuit comprising means for regulating the magnitude of the current flowing through the state switch, said means for regulating comprising switch means, connections between component elements of the electrical circuit and comprising inductive energy storage means in series with the state switch and capacitive energy storage means which, under steady conditions, alternate between constituting means for storing and means for restoring a fraction of the energy of said electrical circuit, depending on the alternating state of said connections between the component elements of the electrical circuit, as determined by the switch means.

2. An electrical circuit according to claim 1, wherein the isolated link is connected in series with the state switch.

3. An electrical circuit according to claim 1, wherein the means for regulating the current through the state switch further include means for monitoring a magnitude characteristic of the state of the electrical circuit and for controlling the switch means to alternate connections between the elements constituting the electrical circuit as a function of the state of said electrical circuit.

4. An electrical circuit according to claim 3, wherein said means for monitoring a magnitude characteristic of the state of the electrical circuit and for periodically controlling the switch means also form the isolated link and for this purpose are provided with said outlet for sending the information and are suitable for sending this information on the basis of processing said characteristic magnitude, in particular on the basis of the duty ratio.

5. An electrical circuit according to claim 3, wherein the peak value during a period of the current flowing through the state switch constitutes said magnitude characteristic of the state of the electrical circuit.

6. An electrical circuit according to claim 3, further comprising means for testing correct operation of the electrical circuit, the means for testing including:

a controlled test switch and a test battery connected in a first series circuit which is in turn connected in parallel with a second series circuit including the state switch and a location for connecting the power supply battery; and an automatic test unit connected to the control terminal of the controlled test switch and to the outlet for transmitting state information, and wherein the automatic test unit, also connected to the means for monitoring a magnitude that is characteristic of the state of the electrical circuit and for operating the switch means of the connections in alternation, is suitable for holding said switch means in at least one current cut-off position in said electrical circuit.

7. An electrical circuit according to claim 1, wherein the switch means for switching the connections between the elements constituting the electrical circuit establish at least the following connections in an alternation:

the inductive energy storage means, the state switch, the power supply battery, and the capacitive energy storage means in series in a closed loop during a first stage, under steady conditions, in which the inductive energy storage means restore a quantity of energy which is stored in the capacitive energy storage means; and the inductive energy storage means, the state switch, and the capacitive energy storage means in series in a closed loop during a second stage, under steady conditions, in which the capacitive energy storage means restore a quantity of energy which is stored by the inductive energy storage means;

the polarity of the connections between the inductive energy storage means and the capacitive energy storage means being inverted between the first and second stages.

8. An electrical circuit according to claim 1, wherein the inductive energy storage means and the capacitive energy storage means comprise respectively: an inductor in series with the state switch; and a capacitor; wherein the electrical circuit has first and second parallel-connected branches in series with the state switch and the inductor, and includes a resistor in parallel with the state switch and the inductor, and connected to a point of the second branch, the capacitor being connected in the second branch; and wherein the means for switching the connections comprises means for directing the current flowing through the state switch and the inductor through the first and second branches in alternation.

9. An electrical circuit according to claim 8, wherein the isolated link is connected in the first branch.

10. An electrical circuit according to claim 8, wherein the isolated link is connected in series with the capacitor in the second branch.

11. An electrical circuit according to claim 8, wherein the isolated link is connected in series with the resistor.

12. An electrical circuit according to claim 8, wherein the period during which the current flowing through the state switch and the inductor flows successively through the first branch and then through the second branch, and the duty ratio which is equal to the time said current flows through the first branch divided by said period, are respectively fixed and variable, and are determined by the means for monitoring the magnitude characteristic of the state of the electrical circuit and for periodically controlling the switch means.

13. An electrical circuit according to claim 8, wherein the means for directing the current passing through the state switch and the inductor alternately through the first branch and through the second branch comprise a controlled switch connected in the first branch and a diode connected in the second branch between firstly one of the two junctions between the first and second branches, and secondly the connection point between the resistor and the second branch, the capacitor lying between the other one of said two junctions between the first and second branches, and the connection point of the resistor and the second branch.

14. An electrical circuit according to claim 13, wherein the isolated link is connected in series with the diode.

15. An electrical circuit according to claim 8, wherein the potential at the point where the resistor is connected to the second branch constitutes a magnitude characteristic of the state of the electrical circuit.

16. An electrical circuit according to claim 8, wherein the voltage across the terminals of the resistor constitutes a magnitude characteristic of the state of the electrical circuit.

17. An electrical circuit according to claim 1, wherein the isolated link consists in an optocoupler.

18. An electrical circuit according to claim 1, wherein the isolated link consists in a transformer.

19. An electrical circuit according to claim 1, wherein the isolated link consists in a transformer connected in series with the state switch and whose primary winding also forms at least a portion of the inductive energy storage means.

20. An electrical circuit according to claim 1, further including means for testing correct operation thereof, independently of the position of the state switch.

21. An electrical circuit according to claim 20, wherein the means for testing correct operation of the electrical circuit include:

a controlled test switch and a test battery connected in a first series circuit which is in turn connected in parallel with a second series circuit including the state switch and a location for connecting the power supply battery; and an automatic test unit connected to the control terminal of the controlled test switch and to the outlet for transmitting state information.

22. An electrical circuit according to claim 20, wherein the means for testing correct operation of the electrical circuit include:

a controlled test switch connected in parallel with the state switch, the assembly being connected in series with a location for connecting the power supply battery that is also to operate as a test battery; and an automatic test unit connected to the control terminal of the controlled test switch and to the outlet for transmitting state information.

23. An electrical circuit according to claim 20, wherein the means for testing correct operation of the electrical circuit include at least one protective diode connected in series with the state switch to block current coming from the controlled test switch.

24. An electrical circuit according to claim 23, wherein the means for testing correct operation of the electrical circuit include another protective diode connected in series with the controlled test switch to block current coming from the state switch.

25. An electrical system for transmitting a plurality of items of state information, the system comprising a power supply battery and a plurality of electrical circuits according to claim 1, each serving to transmit one item of state information and all connected in parallel across the terminals of said battery.

26. An electrical system according to claim 25, the system being mounted on board a railway train, each state switch being associated with one of a member and a piece of equipment of said railway train, to monitor the state or the position thereof.

* * * * *